US007855694B2

(12) United States Patent
Watanabe

(10) Patent No.: US 7,855,694 B2
(45) Date of Patent: Dec. 21, 2010

(54) RADIO SYSTEM, RADIO APPARATUS, AND ANTENNA DEVICE

(75) Inventor: Hiroshi Watanabe, Hachioji (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 402 days.

(21) Appl. No.: 12/148,974

(22) Filed: Apr. 24, 2008

(65) Prior Publication Data

US 2009/0085819 A1 Apr. 2, 2009

(30) Foreign Application Priority Data

Sep. 27, 2007 (JP) ..... P2007-252029

(51) Int. Cl.
*H01Q 7/04* (2006.01)
*H01Q 1/52* (2006.01)
*H01Q 1/00* (2006.01)

(52) U.S. Cl. ..... 343/842; 343/841; 343/787

(58) Field of Classification Search ..... 343/841, 343/842, 787, 788, 741, 742, 866, 867
See application file for complete search history.

(56) References Cited

U.S. PATENT DOCUMENTS 7,460,018 B2 * 12/2008 Kubo ..... 340/572.7
7,561,114 B2 * 7/2009 Maezawa et al. ..... 343/841
2007/0069961 A1 3/2007 Akiho et al.

FOREIGN PATENT DOCUMENTS

JP 2003-067689 A 3/2003
JP 2005-210223 * 8/2005
JP 2006-005836 A 1/2006
JP 2006-178713 A 7/2006
JP 2007-122225 A 5/2007

OTHER PUBLICATIONS

Related U.S. Appl. No. 12/072,346, filed Feb. 26, 2008 ; Inventor: Hiroshi Watanabe.
Related U.S. Appl. No. unknown, filed Apr. 22, 2008; Inventor: Hiroshi Watanabe; entitled: Radio Communication Device and Radio Communication System.

* cited by examiner

*Primary Examiner*—Hoang V Nguyen
(74) *Attorney, Agent, or Firm*—Holtz, Holtz, Goodman & Chick, PC

(57) ABSTRACT

According to an aspect of the present invention, there is provided a radio system including: a first radio apparatus that has a first loop antenna; and a second radio apparatus that has a second loop antenna and that performs a radio communication with the first radio apparatus when the second loop antenna is opposed with the first loop antenna, wherein the second radio apparatus has a shield member that is formed of a magnetic substance and disposed to shield at least a portion of the second loop antenna with respect to the first loop antenna when the radio communication is performed.

15 Claims, 6 Drawing Sheets

RADIO SYSTEM, RADIO APPARATUS, AND ANTENNA DEVICE

CROSS-REFERENCE TO RELATED APPLICATIONS

The entire disclosure of Japanese Patent Application No. 2007-252029 filed on Sep. 27, 2007 including specification, claims, drawings and abstract is incorporated herein by reference in its entirety.

BACKGROUND OF THE INVENTION

1. Field of the Invention

An aspect of the present invention relates to a radio system, radio apparatus, and an antenna device, and more particularly to an antenna device including a loop-type antenna element and radio apparatus and a radio system using the antenna device.

2. Description of the Related Art

An individual identification technique utilizing radio communication (Radio Frequency Identification which will be abbreviated hereinafter as "RFID") is widely utilized for automatic ticket gates of a railway, management of times of arrival and departure of employees at and from a corporation or an office, various types of electronic money, and the like. In the RFID, information is exchanged through radio communication between a device (reader/writer) and an information medium (card or tag). A loop antenna built into the reader/writer and a loop antenna built into the card are held in a communicable state while being opposed each other, whereupon the reader/writer can write information into the card or read information from the card.

Some types of portable cellular phones are equipped with a function compatible with such RFID. In recent years, the portable cellular phones have not only the card function but also the reader/writer function. There is a strong request for miniaturization of the reader/writer including a portable cellular phone. However, there is a problem of a metallic portion of the device intended for miniaturization coming close to a loop antenna, thereby generating an eddy current induced by an A.C. magnetic field and shortening a communicable distance between the reader/writer and a card.

A technique of preventing generation of such an eddy current by utilization of a magnetic substance has been disclosed (see, e.g., JP-A-2007-122225 or JP-A-2006-178713). In a non-contact IC card reader described in JP-A-2007-122225, the decorative laminate panel is attached to the mount frame (made of metal), which is used to mount the module onto the housing, through a base. A loop antenna is laminated on the base by through the magnetic substance layer, to thus shield a space between the antenna and the mount frame with the magnetic substance layer and prevent occurrence of an eddy current in the mount frame.

An information processing device described in JP-A-2006-178713 has a structure in which a conductive plate, a magnetic substance, and an antenna substrate are sequentially arranged on a circuit substrate in a layered manner, thereby shielding the circuit substrate from a magnetic flux of the antenna and preventing occurrence of an eddy current.

In the RFID, loop antennas built into the reader/writer and the card constitute respectively resonators, and nominal values of resonance frequencies of the resonators are set equally to each other. In general, it is known that, when two resonators having the same resonance frequency come close to each other, frequencies of the two resonators are gradually separated toward two frequencies f1 and f2 (f1<f2) (for example, Kawaguchi et al., "Study of Equivalent Circuit Display of Electromagnetic Coupling between Distributed Constant Resonators", Technical Research Report EMCJ2003-78/MW2003-175 of the IEICE, October, 2003; and Ito et al., "Relationship between a Dead Zone and a Coupling Coefficient in an HF band RFID", General Convention B-1-143 of the IEICE, March, 2007). This phenomenon is called a frequency split. The frequency split arises when strong coupling occurs as a result of a space between the reader/writer and the card being reduced to a certain extent or more. When the value of the frequency split increases in excess of a limit, it may be the case where communication cannot be established between the reader/writer and the card.

The frequency split is described by reference to FIGS. 11 through 13 while taking the RFID system as an example. FIG. 11 is an exemplary measurement result of a frequency characteristic of a return loss of a card for an RFID system. A horizontal axis in the drawing represents a frequency; the center of the plot corresponds to 13.56 megahertz (MHz); and one tick mark corresponds to 1 MHz. A vertical axis in the drawing represents a return loss; the maximum value represents 0 dB; and one tick mark corresponds to 1 dB.

FIG. 12 shows an exemplary measurement result of a frequency characteristic of a return loss of a related-art reader/writer for an RFID system. A horizontal axis in FIG. 12 is identical with the horizontal axis shown in FIG. 11. A vertical axis in FIG. 12 represents a return loss; the maximum value corresponds to 0 dB; and one tick mark corresponds to 0.2 dB.

FIG. 13 is an exemplary measurement result of frequency characteristic of return losses performed when the loop antenna of the card whose characteristic is shown in FIG. 11 and the loop antenna of the reader/writer whose characteristic shown in FIG. 12 are brought closely to each other in a mutually-opposing manner. The horizontal axis and the vertical axis shown in the drawing are identical with their counterparts in FIG. 12. In the drawings, a left resonance point represents a resonance point of the card, and a right resonance point represents a resonance point of the reader/writer. In this case, the value of the foregoing frequency split has come to about 5.5 MHz, whereupon the frequency split manifests itself noticeably. Under such conditions, it is extreme difficult to perform radio communication between the card and the reader/writer.

The related-art technique described in JP-A-2007-122225 is intended for assuring a communicable distance by means of preventing occurrence of an eddy current, which would otherwise be arise in a metal mount frame, to thus lessen an adverse effect on an antenna characteristic. However, no consideration is given to the problem of the frequency split induced as a result of the reader/writer coming closely to the card.

The related-art technique described in JP-A-2006-178713 is directed toward preventing a magnetic flux from reaching a substrate by converting a magnetic flux leaked from an antenna into an eddy current by means of a conductive plate, thereby preventing occurrence of an eddy current also. However, no consideration is given to the problem of the frequency split induced as a result of the reader/writer coming closely to the card.

SUMMARY OF THE INVENTION

According to an aspect of the present invention, there is provided a radio system including: a first radio apparatus that has a first loop antenna; and a second radio apparatus that has a second loop antenna and that performs a radio communication with the first radio apparatus when the second loop antenna is opposed with the first loop antenna, wherein the second radio apparatus has a shield member that is formed of a magnetic substance and disposed to shield at least a portion of the second loop antenna with respect to the first loop antenna when the radio communication is performed.

According to another aspect of the present invention, there is provided a radio apparatus including: a built-in loop antenna that is to be opposed with a loop antenna of an external apparatus for performing a radio communication between the radio apparatus and the external apparatus; and a shield member that is formed of a magnetic substance disposed to shield at least a portion of the built-in loop antenna with respect to the loop antenna of the external apparatus when the radio communication is performed.

According to still another aspect of the present invention, there is provided an antenna device that is included in a radio apparatus and that is to be opposed with a loop antenna of an external apparatus for performing a radio communication between the radio apparatus and the external apparatus, the antenna device including: an antenna element that is formed into a loop shape; and a shield member that is formed of a magnetic substance disposed to shield at least a portion of the antenna element with respect to the loop antenna of the external apparatus when the radio communication is performed.

BRIEF DESCRIPTION OF THE DRAWINGS

Embodiment may be described in detail with reference to the accompanying drawings, in which.

DETAILED DESCRIPTION OF THE INVENTION

Figure 1:
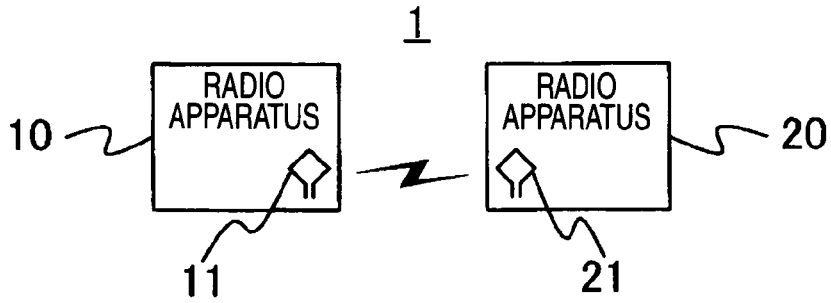
FIG. 1 is a block diagram of a radio system of an embodiment.

An embodiment of the present invention is described hereunder by reference to FIGS. 1 through 10. When up, down, right, and left, or a horizontal direction and a vertical direction (a normal direction) are referred to by reference to the drawings provided below, the directions signify up, down, right, and left, or a horizontal direction and a vertical direction (a normal direction) of a drawing sheet having a picture unless otherwise specified. Moreover, like reference numerals designate like configurations throughout the drawings.

FIG. 1 is a block diagram showing the configuration of a radio system 1 of the embodiment. The radio system 1 has radio apparatus 10 and radio apparatus 20. The radio system 1 may be considered as an individual identification system (an RFID) utilizing a radio frequency; the radio apparatus 10 may be considered as a card in the RFID system; and the radio apparatus 20 may be considered as a reader/writer or a portable cellular phone having a built-in reader/writer function.

The radio apparatus 10 has a loop antenna 11 built thereinto. The radio apparatus 20 has a loop antenna 21 built thereinto. The radio apparatus 20 can perform radio communication with the radio apparatus 10 when the loop antenna 21 is positioned opposite the loop antenna 11. Here, the term "communication" includes exchange of information, such as writing of information into an information medium typified by the RFID system or reading of information from the information medium.

Figure 2:
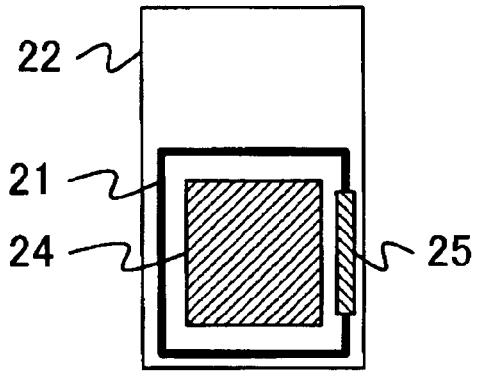
FIG. 2 is a plan view showing a substrate of a radio apparatus of the embodiment and the configuration of a periphery of the substrate.
Figure 3:
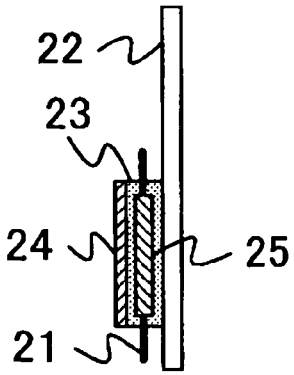
FIG. 3 is a side view showing the substrate of the radio apparatus and the configuration of the periphery of the substrate.

FIG. 2 is a plan view showing a substrate 22 of the radio apparatus 20 and the configuration of the periphery of the substrate (including the loop antenna 21). FIG. 3 is a side view showing the substrate 22 and the configuration of the periphery of the substrate when viewed from a right side in FIG. 2. As shown in FIG. 3, a battery 23 is attached to one surface of the substrate 22. The battery 23 is housed in a metal package. A surface of the battery 23 opposite to the substrate 22 is provided with a magnetic substance 24. The magnetic substance 24 is formed into; for example, a sheet, and affixed to the surface of the battery 23. FIG. 2 shows a state where the battery 23 is covered with the magnetic substance 24, to thus remain hidden from view.

The loop antenna 21 has an antenna element that is formed into the shape of a loop and arranged to surround the battery 23. In reality, an unillustrated feeding point is provided at any location on the antenna element and connected to and fed power from an unillustrated radio circuit of the radio apparatus 20. A magnetic substance 25 is arranged while wrapping at least a portion of the loop antenna 21.

Figure 4:
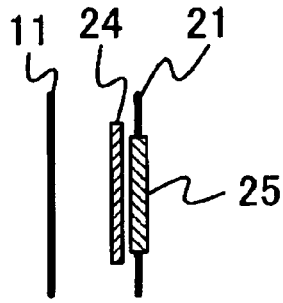
FIG. 4 is a side view showing a positional relationship between a loop antenna and a magnetic substance of the embodiment.
Figure 5:
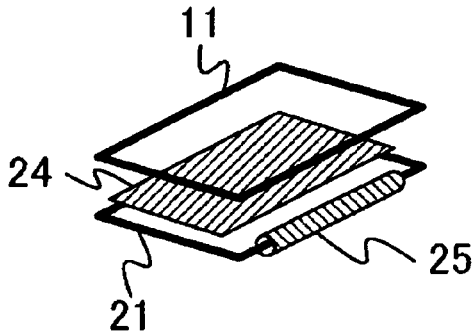
FIG. 5 is a perspective view showing a positional relationship between a loop antenna and a magnetic substance of the embodiment.

The advantages realized by providing the magnetic substance 24 and the magnetic substance 25 will now be described by reference to FIGS. 4 and 5. FIG. 4 is a view showing a positional relationship among the loop antenna 11, the loop antenna 21, the magnetic substance 24, and the magnetic substance 25 when the loop antenna 21 is positioned opposite the loop antenna 11 as shown in FIG. 1 and when viewed in the same direction as in FIG. 3. FIG. 5 is a perspective view showing a similar positional relationship while the loop antenna 11 is positioned above.

When the loop antenna 21 is excited, an A.C. magnetic field is induced. The magnetic substance 24 suppresses an eddy current arising in the metal package of the battery 23 caused by the A.C. magnetic field. However, as is inferred by reference to FIG. 5, when the loop antenna 11 or the loop antenna 12 is excited, the density of a magnetic flux penetrating through the loops is intensified by the presence of the magnetic substance 24. Hence, coupling between the loop antenna 11 and the loop antenna 21 is intensified (a Q value of the loop antenna 11 and a Q value of the loop antenna 21 are also increased at this time). Consequently, a frequency split becomes likely to arise.

In the meantime, the magnetic substance 25 is arranged to wrap at least a portion of the loop antenna 21. In the portion of the loop antenna 21 where the magnetic substance 25 is wrapped, a magnetic field induced by an antenna current is shielded, thereby suppressing leaks to the outside. Therefore, influence on the loop antenna 11 can be diminished. In short, occurrence of the frequency split can be lessened by preventing coupling between the loop antenna 11 and the loop antenna 21.

A location and a range on the loop antenna 21 wrapped with the magnetic substance 25 can be selected appropriately according to a design or usage conditions (an interval between the loop antenna 11 and the loop antenna 21, transmission power, receiving sensitivity, and the like).

Figure 6:
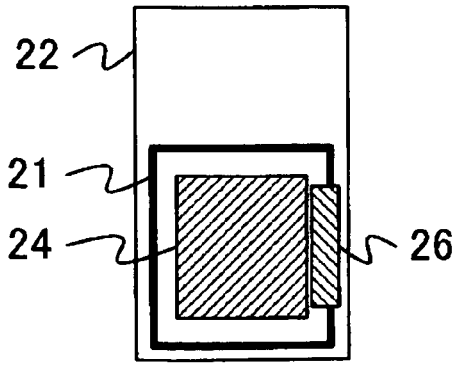
FIG. 6 is a plan view showing a substrate of a radio apparatus of a modified embodiment and the configuration of the periphery of the substrate.
Figure 7:
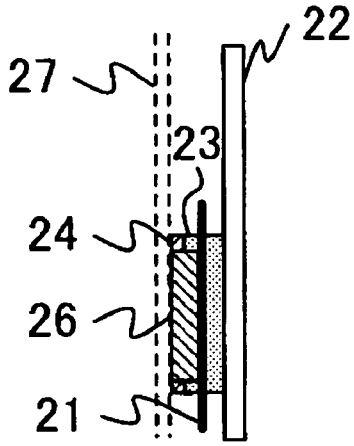
FIG. 7 is a side view showing the substrate of the radio apparatus of the modified embodiment and the configuration of the periphery of the substrate.

By reference to FIGS. 6 through 8, a modified embodiment will be described. In the modified embodiment, the magnetic substance is modified form the magnetic substance 25 of the foregoing embodiment. Therefore, respective elements of the structure are assigned the same reference numerals of the previously-described elements except the magnetic substance 25. FIG. 6 is a plan view showing the substrate 22 of the radio apparatus 20 and the configuration of the periphery of the substrate (including the loop antenna 21) in the modified embodiment. FIG. 7 is a side view showing the substrate 22 and the configuration of the periphery of the substrate when viewed from a right side in FIG. 6.

In FIGS. 6 and 7, a positional relationship among the loop antenna 21, the substrate 22, the battery 23, and the magnetic substance 24 is the same as that described by reference to FIGS. 2 and 3. In FIG. 7, a magnetic substance 26 is disposed to cover at least a portion of the loop antenna 21. The magnetic substance 26 may also be attached to an interior surface of a housing case 27 of the radio apparatus 20 indicated by a broken line in FIG. 7.

Figure 8:
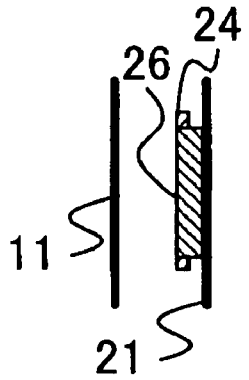
FIG. 8 is a side view showing a positional relationship between a loop antenna and a magnetic substance of the modified embodiment.

FIG. 8 is a view showing, when viewed in the same direction as that in FIG. 7, a positional relationship among the loop antenna 11, the loop antenna 21, the magnetic substance 24, and the magnetic substance 26 achieved when the loop antenna 21 is positioned opposite the loop antenna 11 as shown in FIG. 1.

The frequency split becomes more likely to arise because of presence of the magnetic substance 24 as already mentioned. In the meantime, the magnetic substance 26 is disposed to cover at least a portion of the loop antenna 21 from the loop antenna 11. The magnetic substance 26 shields a magnetic field induced by the loop antenna 21 and prevents the magnetic filed from leaking toward a direction where the loop antenna 11 is to be positioned. Hence, influence on the loop antenna 11 can be diminished. In other words, coupling between the loop antenna 11 and the loop antenna 21 is suppressed, to thus lessen a frequency split.

A location and a range on the loop antenna 21 wrapped with the magnetic substance 26 can be selected appropriately according to a design or usage conditions (an interval between the loop antenna 11 and the loop antenna 21, transmission power, receiving sensitivity, and the like).

An advantage of the embodiments verified by experiment is now described by reference to FIGS. 9 and 10.

Figure 9:
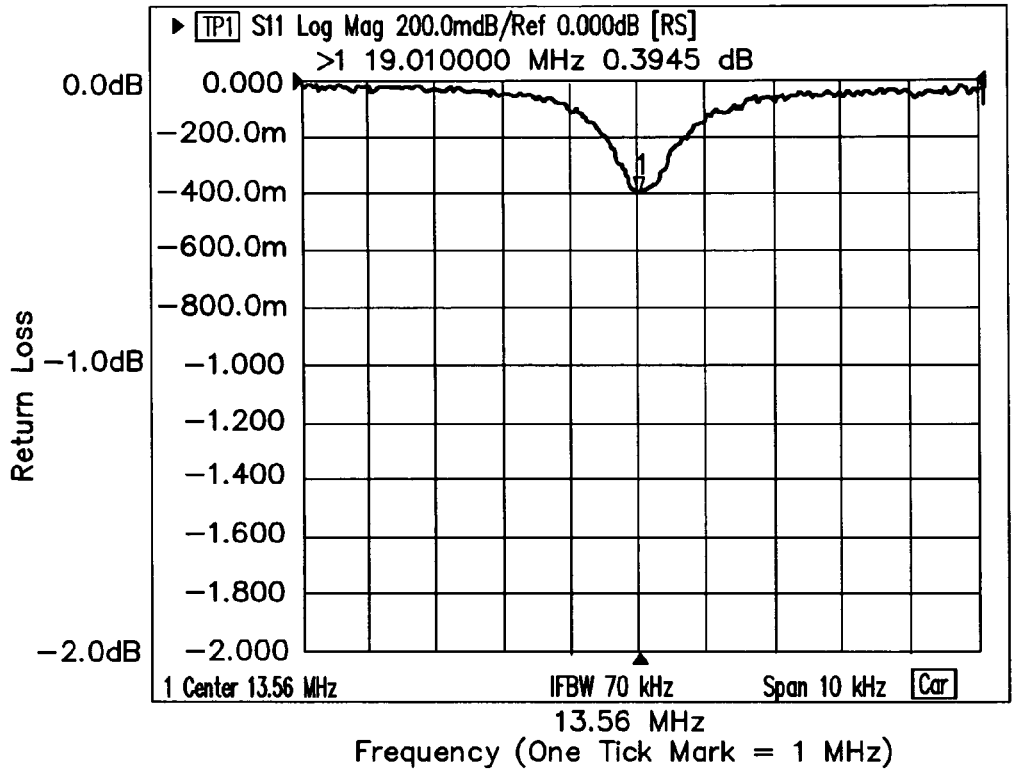
FIG. 9 is an exemplary measurement result of a frequency characteristic of a return loss of the reader/writer in an RFID system of the embodiment.

FIG. 9 is an exemplary measurement result of a frequency characteristic of a return loss of a reader/writer to which one of the embodiments is applied. A horizontal axis in the drawing represents a frequency; the center of the plot corresponds to 13.56 megahertz (MHz); and one tick mark corresponds to 1 MHz. A vertical axis in the drawing represents a return loss; the maximum value represents 0 dB; and one tick mark corresponds to 0.2 dB.

Figure 10:
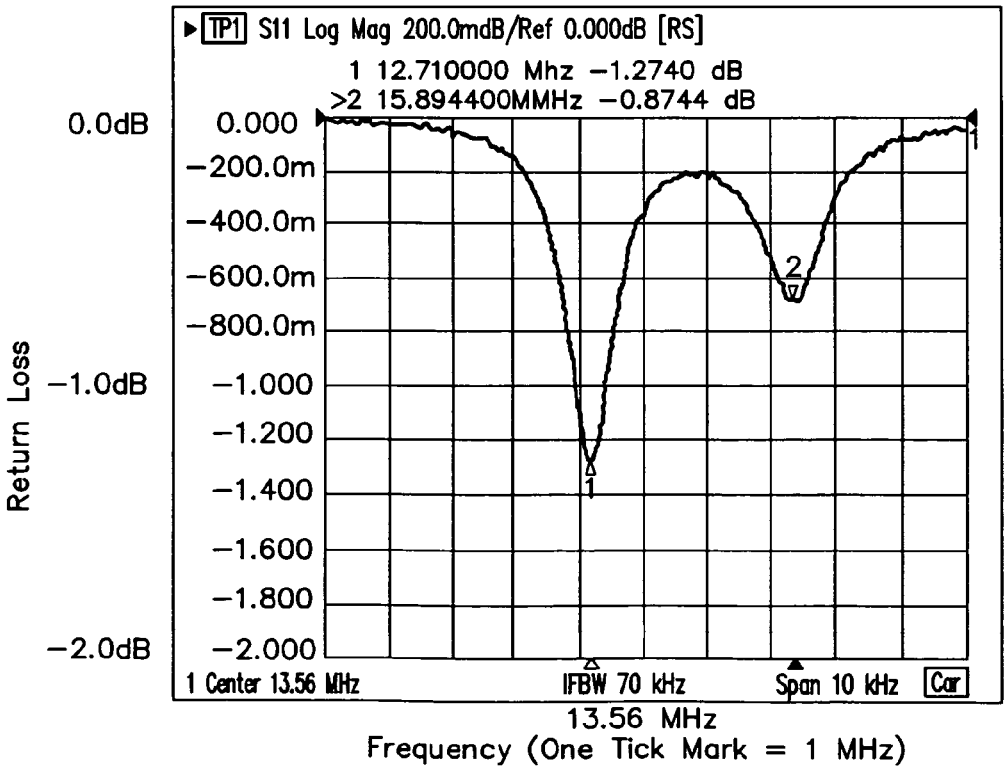
FIG. 10 shows an exemplary measurement result of a frequency characteristic of return losses of the reader/writer and of the card in the RFID system of the embodiment acquired when loop antennas of the reader/writer and the card are opposed closely each other.
Figure 11:
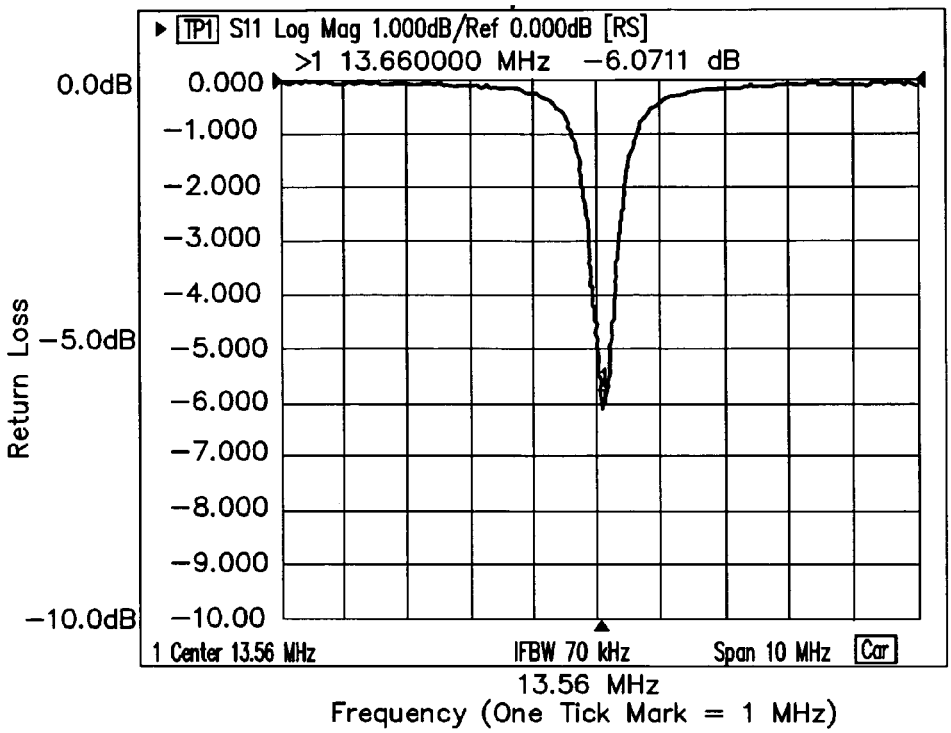
FIG. 11 is an exemplary measurement result of a frequency characteristic of a return loss of a card for an RFID system.
Figure 12:
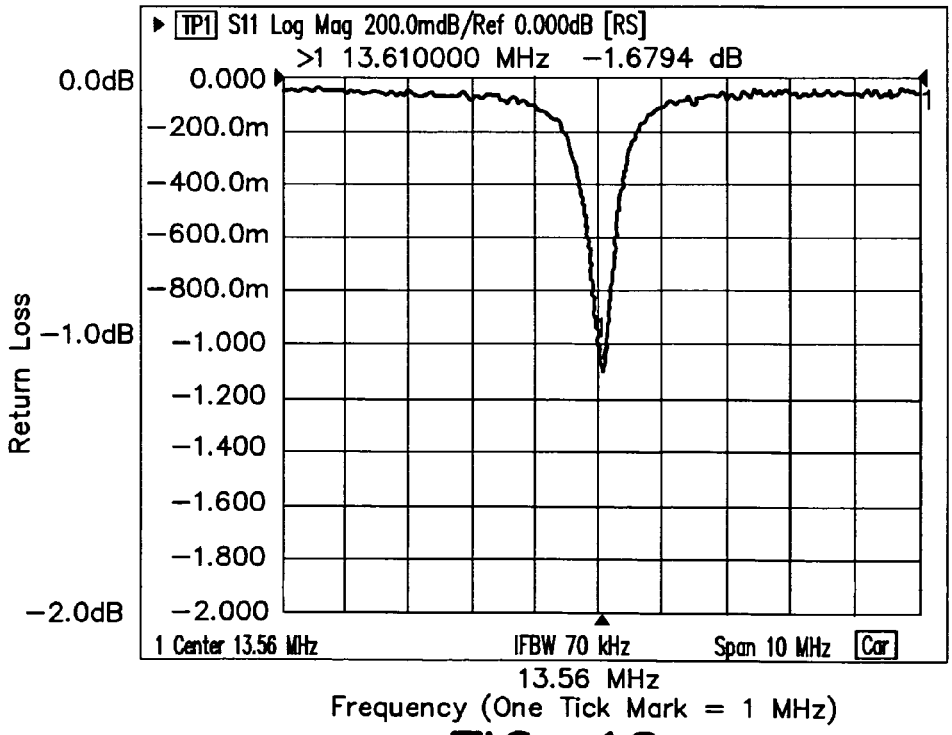
FIG. 12 is an exemplary measurement result of a frequency characteristic of a return loss of a related-art reader/writer for an RFID system.
Figure 13:
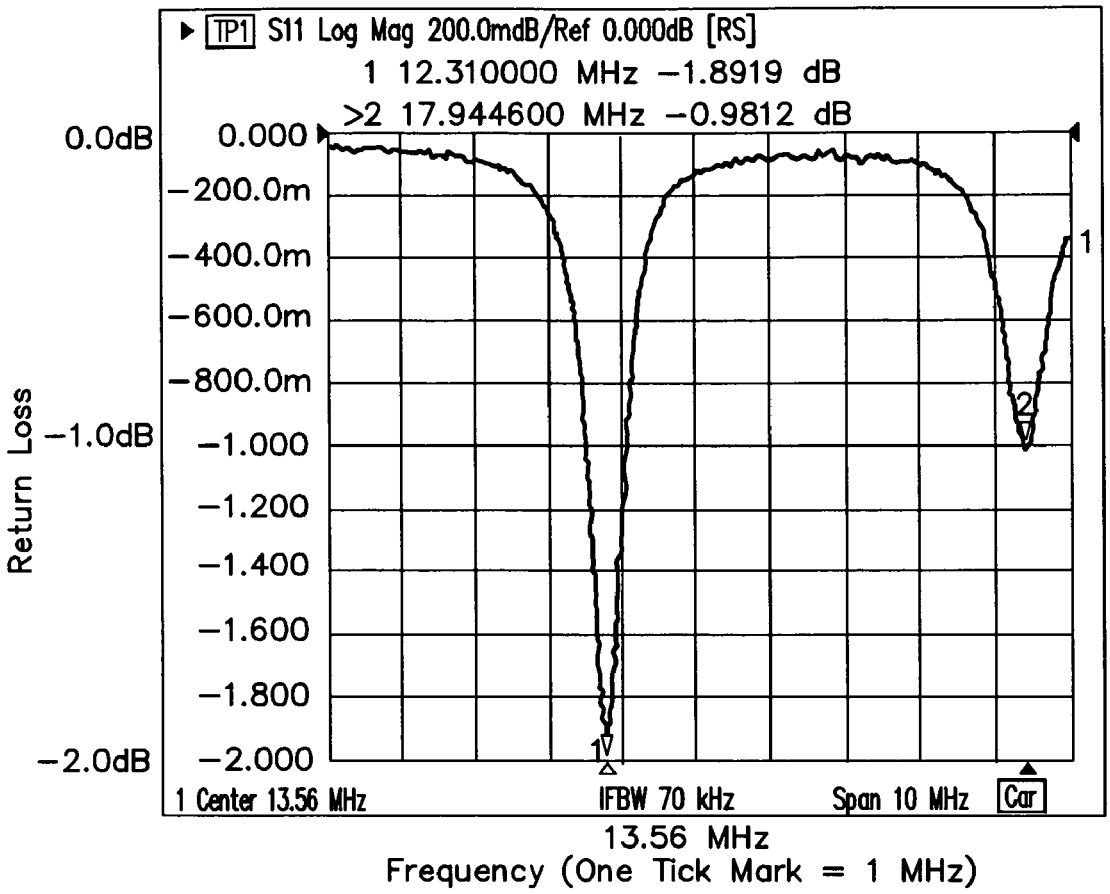
FIG. 13 shows an exemplary measurement result of a frequency characteristic of return losses of a related-art reader/writer and of a card for an RFID system acquired when loop antennas of the related-art reader/writer and the card are opposed closely each other.

FIG. 10 is an exemplary measurement result of frequency characteristic of return losses performed when a loop antenna of the card whose characteristic is shown in FIG. 11 in connection with the descriptions of the related art and a loop antenna of the reader/writer whose characteristic is shown in FIG. 9 are brought closely to each other in a mutually-opposing manner. In the drawings, a left resonance point represents a resonance point of the card, and a right resonance point represents a resonance point of the reader/writer. In this case, the present invention is applied to the reader/writer. Hence, as is evident from a comparison with FIG. 13, the value of the foregoing frequency split is improved to a little more than 3 MHz or thereabouts. Under such conditions, communication can be established between the card and the reader/writer in a more reliable manner than in the related art.

According to the foregoing embodiment, the magnetic substance is disposed to shield at least a portion of one loop antenna from another loop antenna, whereby a frequency split induced when both loop antennas are closely opposed is reduced, so that a communicable state can be maintained.

In the embodiment mentioned above, shapes, layouts, positional relationships, and the like, of the respective constituent elements and conditions set in experiment are mere illustrative. They are susceptible to various modifications without departing from the gist of the present invention.

According to an aspect of the present invention, in one piece of radio apparatus constituting a radio system, a magnetic substance is arranged to shield at least a portion of a loop antenna of the radio apparatus from a loop antenna of another piece of radio apparatus, thereby preventing occurrence of a frequency split, which would otherwise be caused when loop antennas of radio apparatus comes closely to each other, to thus ensure stable communication.

What is claimed is:

1. A radio system comprising:

a first radio apparatus that has a first loop antenna; and a second radio apparatus that has a second loop antenna and that performs a radio communication with the first radio apparatus when the second loop antenna is opposed with the first loop antenna, wherein the second radio apparatus has a shield member that is formed of a magnetic substance and disposed to shield at least a portion of the second loop antenna with respect to the first loop antenna when the radio communication is performed.

2. The radio system according to claim 1, wherein the shield member is disposed to wrap at least a portion of the second loop antenna.

3. The radio system according to claim 1, wherein the second radio apparatus has a second shield member that is formed of a magnetic substance and disposed to be penetrated by magnetic fluxes of the second loop antenna and of the first loop antenna when the radio communication is performed.

4. The radio system according to claim 1, wherein the second antenna is formed into a rectangular shape.

5. The radio system according to claim 1, wherein the second radio apparatus has a housing case; and wherein the shield member is attached to an interior surface of the housing case.

6. A radio apparatus comprising:

a built-in loop antenna that is to be opposed with a loop antenna of an external apparatus for performing a radio communication between the radio apparatus and the external apparatus; and a shield member that is formed of a magnetic substance disposed to shield at least a portion of the built-in loop antenna with respect to the loop antenna of the external apparatus when the radio communication is performed.

7. The radio apparatus according to claim 6, wherein the shield member is disposed to wrap at least a portion of the built-in loop antenna.

8. The radio apparatus according to claim 6, further comprising:

a second shield member that is formed of a magnetic substance and disposed to be penetrated by magnetic fluxes of the built-in loop antenna and the loop antenna of the external apparatus when the radio communication is performed.

9. The radio apparatus according to claim 6, wherein the built-in loop antenna is formed into a rectangular shape.

10. The radio apparatus according to claim 6 further comprising:

a housing case;

wherein the shield member is attached to an interior surface of the housing case.

11. An antenna device that is included in a radio apparatus and that is to be opposed with a loop antenna of an external apparatus for performing a radio communication between the radio apparatus and the external apparatus, the antenna device comprising:

an antenna element that is formed into a loop shape; and a shield member that is formed of a magnetic substance disposed to shield at least a portion of the antenna element with respect to the loop antenna of the external apparatus when the radio communication is performed.

12. The antenna device according to claim 11, wherein the shield member is disposed to wrap at least a portion of the antenna element.

13. The antenna device according to claim 11, further comprising:

a second shield member that is formed of a magnetic substance and disposed to be penetrated by magnetic fluxes of the antenna element and the loop antenna of the external apparatus when the radio communication is performed.

14. The antenna device according to claim 11, wherein the antenna element is formed into a rectangular shape.

15. The antenna device according to claim 11 further comprising:

a housing case;

wherein the shield member is attached to an interior surface of the housing case.

* * * * *